US010006467B2

(12) United States Patent
Guemmer

(10) Patent No.: US 10,006,467 B2
(45) Date of Patent: Jun. 26, 2018

(54) ASSEMBLY FOR A FLUID FLOW MACHINE

(71) Applicant: Rolls-Royce Deutschland Ltd & Co KG, Blankenfelde-Mahlow (DE)

(72) Inventor: Volker Guemmer, Mahlow (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 520 days.

(21) Appl. No.: 14/290,200

(22) Filed: May 29, 2014

(65) Prior Publication Data

US 2015/0086344 A1 Mar. 26, 2015

(30) Foreign Application Priority Data

May 31, 2013 (DE) ..... 10 2013 210 169

(51) Int. Cl.
*F04D 29/52* (2006.01)
*F04D 29/16* (2006.01)
(Continued)

(52) U.S. Cl.
CPC ..... *F04D 29/161* (2013.01); *F04D 29/526* (2013.01); *F04D 29/541* (2013.01); *F04D 29/681* (2013.01); *F04D 29/685* (2013.01)

(58) Field of Classification Search
CPC ..... F01D 17/105; F01D 11/12; F01D 11/122; F04D 29/541; F04D 29/681;
(Continued)

(56) References Cited

U.S. PATENT DOCUMENTS 5,308,225 A * 5/1994 Koff ..... F01D 11/08 415/57.3
5,586,859 A 12/1996 Nolcheff
(Continued)

FOREIGN PATENT DOCUMENTS

DE 69616435 1/1997
DE 10135003 10/2002
(Continued)

OTHER PUBLICATIONS

European Search Report dated Nov. 3, 2014 for counterpart European Patent Application No. 14170068.2.

*Primary Examiner* — Logan Kraft
*Assistant Examiner* — Sabbir Hasan
(74) *Attorney, Agent, or Firm* — Shuttleworth & Ingersoll, PLC; Timothy J. Klima

(57) ABSTRACT

A fluid-flow machine includes: a main flow path boundary and at least one row of relatively rotating blades with a gap existing between blade ends and the main flow path boundary. At least one secondary flow duct having one opening each is provided in the main flow path boundary at ends spaced apart in the flow direction, such that the secondary flow duct is connected to the main flow path via the two openings. The structural assembly has at least one support component and at least one insertion component. The support component includes a recess extending in the circumferential direction that receives the at least one insertion component such that the support component surrounds the at least one insertion component largely on its sides not facing the main flow path, and where the insertion component completely surrounds or forms at least one secondary flow duct.

19 Claims, 9 Drawing Sheets

Figure 1A:
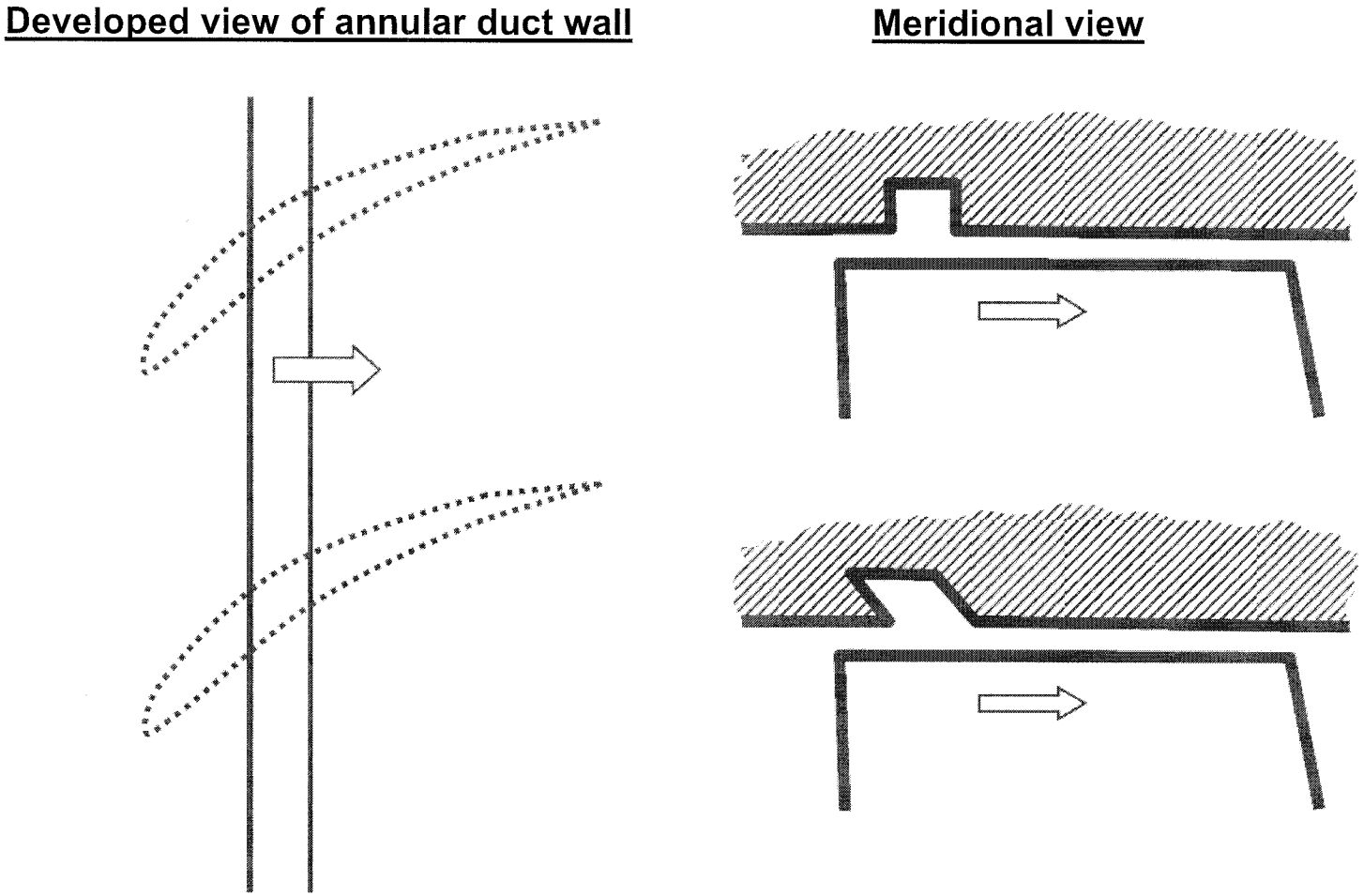

(51) Int. Cl.
*F04D 29/54* (2006.01)
*F04D 29/68* (2006.01)

(58) Field of Classification Search
CPC .... F04D 29/682; F04D 29/684; F04D 29/685; F04D 29/526; F04D 27/023; F04D 27/0238; F05D 2270/17; F05D 2260/606
USPC ..... 415/57.1, 57.3, 57.4, 58.5, 58.7, 173.4, 415/173.5, 174.4
See application file for complete search history.

(56) References Cited

U.S. PATENT DOCUMENTS 5,950,308 A 9/1999 Koff
6,585,479 B2 * 7/2003 Torrance ..... F01D 11/08 415/58.5
6,742,983 B2 6/2004 Schmuecker
7,600,965 B2 * 10/2009 Seitz ..... F01D 11/08 415/144
7,967,556 B2 * 6/2011 Gummer ..... F04D 27/0215 415/144
8,043,046 B2 * 10/2011 Guemmer ..... F04D 29/681 415/115
8,152,445 B2 4/2012 Guemmer
8,262,340 B2 9/2012 Guemmer
8,382,422 B2 2/2013 Guemmer
2005/0226717 A1 10/2005 Xu
2006/0153673 A1 * 7/2006 Guemmer ..... F01D 5/145 415/115
2013/0236300 A1 * 9/2013 Hiller ..... F04D 27/0238 415/182.1

FOREIGN PATENT DOCUMENTS

DE 10330084 3/2004
DE 102008037154 2/2010
EP 0497574 8/1992
EP 0751280 1/1997
EP 0754864 1/1997
EP 1286022 2/2003
EP 1659293 5/2006

* cited by examiner

Developed view of annular duct wall

Axial view

ASSEMBLY FOR A FLUID FLOW MACHINE

This application claims priority to German Patent Application 102013210169.4 filed May 31, 2013, the entirety of which is incorporated by reference herein.

This invention relates to a structural assembly for a fluid-flow machine.

The aerodynamic loadability and the efficiency of fluid-flow machines, in particular of fluid-flow machines such as blowers, compressors, pumps and fans, is limited by the growth and the separation of boundary layers in the rotor and stator blade tip area near the casing or the hub wall, respectively. On blade rows with running gap, this leads to high secondary losses and possibly to the occurrence of operational instabilities at higher loads.

A known counter-measure is to use so-called casing treatments. The simplest form of casing treatments are circumferential grooves having rectangular or parallelogram-shaped cross-sections, as disclosed for instance in EP 0 754 864 A1 and illustrated in FIG. 1 a by way of example. Other solutions provide for rows of slots or openings in the casing, with the individual slots/openings being oriented substantially in the flow direction and having a slender form with a small extent when viewed in the circumferential direction of the machine. Solutions of this kind are disclosed for instance in DE 101 35 003 C1 and illustrated in FIG. 1*b* by way of example.

Further casing treatments include provision of a ring over the entire circumference in the area of a rotor in the casing, with stator vanes often being provided to reduce the flow swirl inside the treated casing, as for example described in the publications EP 0 497 574 A1, US 2005-0226717 A1, U.S. Pat. No. 6,585, 479 B2, US 2005-0226717 A1 and DE 103 30 084 A1.

Existing concepts for casing treatments in the form of slots and/or chambers in the annular duct wall offer increased stability of the fluid-flow machine. This is however only achieved with a loss in efficiency due to the unfavourably selected arrangement or shape. Known solutions also take up a large installation space at the periphery of the annular duct of the fluid-flow machine, and due to their shape (e.g. simple parallelogram-shaped circumferential casing grooves) they are only of restricted effectiveness and are always provided in the casing in the area of a rotor blade row. Casing treatments according to the state of the art are intended for easy implementation in the casing from an accessible side with the aid of machining, usually metal-cutting.

A fluid-flow machine is known from DE 10 2008 037 154 A1, which has, in the area of the blade leading edge in a main flow path boundary, at least one secondary flow duct connecting to one another two openings arranged on the main flow path boundary. Each secondary flow duct connects one discharge opening to a supply opening provided further upstream. The provision of secondary flow ducts of this type permits effective influencing of the boundary layer in the blade tip area and hence allows an increase in the stability of a fluid-flow machine, without the need for an expensive casing treatment over the entire casing circumference in the area of a rotor. However, complex secondary flow ducts in the area of the casing or hub can only be achieved by specific design and production measures.

Based on DE 10 2008 037 154 A1, the object underlying the present invention is to provide a structural assembly that can efficiently provide secondary flow ducts, even those of complex shape, in the area of a main flow path boundary of a fluid-flow machine (i.e. in the area of the casing or hub). The intention is to provide a spatially compact and sturdy structural design.

It is a particular object to provide a solution to the above problems by a structural assembly having features described herein and a fluid-flow machine also having features described herein. Embodiments will become apparent from the present description.

It is accordingly provided in accordance with the invention that the structural assembly has at least one support component and at least one insertion component, where a recess extending in the circumferential direction is provided in the support component and receives at least one insertion component such that the support component surrounds the at least one insertion component largely on its sides not facing the main flow path, and where the insertion component completely surrounds or forms at least one secondary flow duct. In other words, the solution in accordance with the invention creates the secondary flow ducts in a separate component, the insertion component, which is inserted into a recess or opening of the support component which is for example part of the casing or hub confining the main flow duct.

The invention considers a section of the main flow path of a fluid-flow machine, in the area of a blade row with free end and running gap, in which a row of secondary flow ducts distributed in the circumferential direction is provided. The course of the secondary flow ducts can be spatially complex in each case. In accordance with the invention, a structural assembly is provided for structural implementation of said secondary flow ducts.

It can be provided that the insertion component forms the main flow path boundary with at least some of its faces. It can furthermore be provided that the insertion component surrounds at least one secondary flow duct so completely that all wetted surfaces of the secondary flow duct are associated with the insertion component in undivided manner.

According to an embodiment of the invention, the support component is designed as an annular casing of a fluid-flow machine and encloses the at least one insertion component from the outside.

According to a further embodiment of the invention, the support component is designed as a half-shell casing of a fluid-flow machine and encloses the at least one insertion component from the outside.

According to a further embodiment of the invention, the support component is designed annular on the hub of a fluid-flow machine and holds the at least one insertion component from the inside.

According to a further embodiment of the invention, the support component is designed semi-annular on the hub of a fluid-flow machine and holds the at least one insertion component from the inside.

The insertion component can be designed in accordance with the invention as a complete ring or as a ring sector. The insertion component can for example be manufactured by a casting, sintering or printing production method.

An embodiment of the invention provides that the shape and the faces of the insertion component are designed such that said insertion component can be inserted into the support component in the axial direction of the fluid-flow machine and an additional component adjoins the support component in the axial direction and fixes the insertion component. As a result, placement of the insertion component into the support component in the radial direction, as would otherwise be necessary, can be avoided.

An embodiment of the invention provides that an abradable coating is provided on the insertion component, which is designed as a ring sector or complete ring, on at least parts of its face facing the main flow path. To do so, it can also be provided that a further complete or partial ring, on which an abradable coating is provided on at least parts of its face facing the main flow path, adjoins the insertion component on the side facing the main flow path.

The present invention generally relates to structural assemblies for fluid-flow machines, such as turbines, and in particular to fluid-flow machines such as blowers, compressors, pumps and fans of the axial, semi-axial and radial type. The working medium may be gaseous or liquid. The fluid-flow machine may include one or several stages, each having a rotor and a stator. In individual cases, the stage is formed only by a rotor.

The rotor of a fluid-flow machine, in which a structural assembly in accordance with the present invention is used, includes a number of blades, which are connected to the rotating shaft of the fluid-flow machine and impart energy to the working medium. The rotor may be provided with or without shroud at the outer blade end.

The stator of a fluid-flow machine, in which a structural assembly in accordance with the present invention is used, includes a number of stationary vanes, which may have a fixed or a free vane end both on the hub and on the casing side.

The rotor drum and the blading are usually enclosed by a casing. In other cases, e.g. in the case of aircraft or ship propellers, no such casing exists.

A fluid-flow machine, in which a structural assembly in accordance with the present invention is used, may also feature a stator, a so-called inlet guide vane assembly, upstream of the first rotor. Departing from a stationary fixation, at least one stator or inlet guide vane assembly may be rotatably borne, to change the angle of attack. Variation is accomplished for example via a spindle accessible from the outside of the annular duct.

In an embodiment, a fluid-flow machine, in which a structural assembly in accordance with the present invention is used, may include at least one row of variable rotors.

In an embodiment, a fluid-flow machine, in which a structural assembly in accordance with the present invention is used, may have two counter-rotating shafts, in the event of a multi-stage design, with the direction of rotation of the rotor blade rows alternating between stages. Here, no stators exist between subsequent rotors.

In an embodiment, a fluid-flow machine, in which a structural assembly in accordance with the present invention is used, may feature a bypass configuration such that a single-flow annular duct divides into two concentric annular ducts behind a certain blade row, with each of these annular ducts containing at least one further blade row.

The fluid-flow machine, in which a structural assembly in accordance with the present invention is used, is for example a jet engine, in particular a turbofan engine. The structural assembly is for example provided in the area of a compressor of a jet engine or turbofan engine.

The present invention furthermore relates to a fluid-flow machine having a structural assembly in accordance with the present invention.

Figure 4:
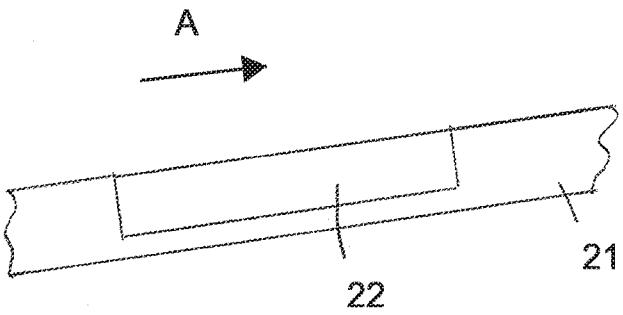
Figure 5:
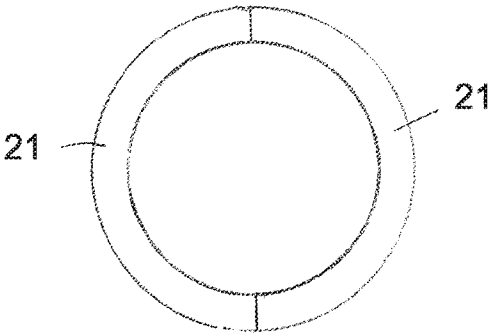

The present invention is described in the following with reference to the figures of the accompanying drawing, showing several exemplary embodiments. In the drawing, FIG. 1A shows, in two views, a casing treatment of a rotor casing in the form of annular grooves in accordance with the state of the art, FIG. 1B shows, in two views, a casing treatment of a rotor casing in the form of slots in accordance with the state of the art, FIG. 2A shows, in meridional sectional view, an exemplary embodiment of a rotor casing of a fluid-flow machine having a secondary flow duct, FIG. 2B shows, in a three-dimensional view, an exemplary embodiment of a rotor casing of a fluid-flow machine having a secondary flow duct, FIG. 3A shows a first exemplary embodiment of a structural assembly for a fluid-flow machine forming a secondary flow duct, FIG. 3B shows a second exemplary embodiment of a structural assembly for a fluid-flow machine forming a secondary flow duct, FIG. 3C shows a third exemplary embodiment of a structural assembly for a fluid-flow machine forming a secondary flow duct, FIG. 3D shows a fourth exemplary embodiment of a structural assembly for a fluid-flow machine forming a secondary flow duct;

FIG. 4 is a schematic view showing the support component as part of a hub; and FIG. 5 is a schematic view showing a semi-annular support component.

Figure 1B:
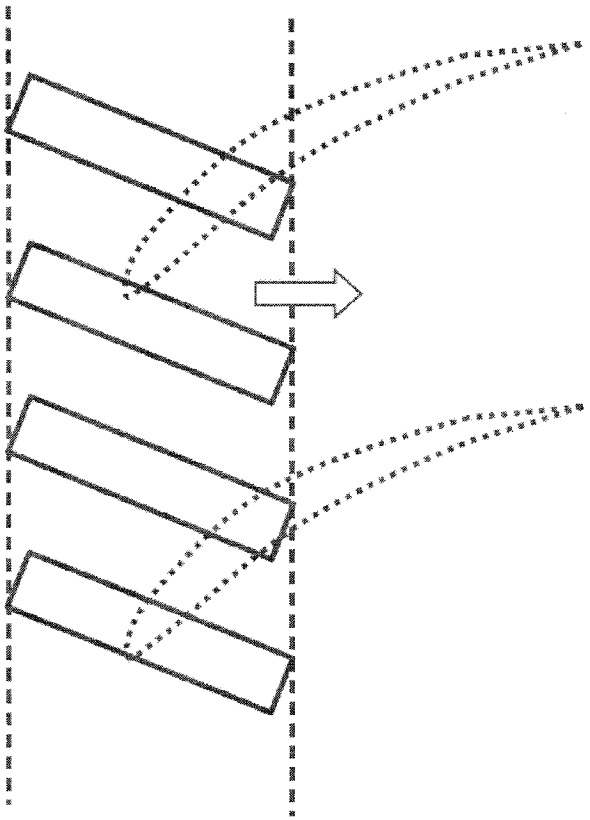
Figure 1B:
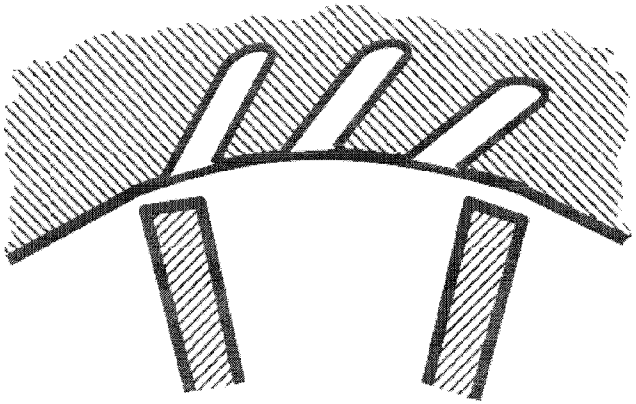

Various casing treatments of a rotor casing according to the state of the art were described at the outset on the basis of FIGS. 1A and 1B.

Figure 2A:
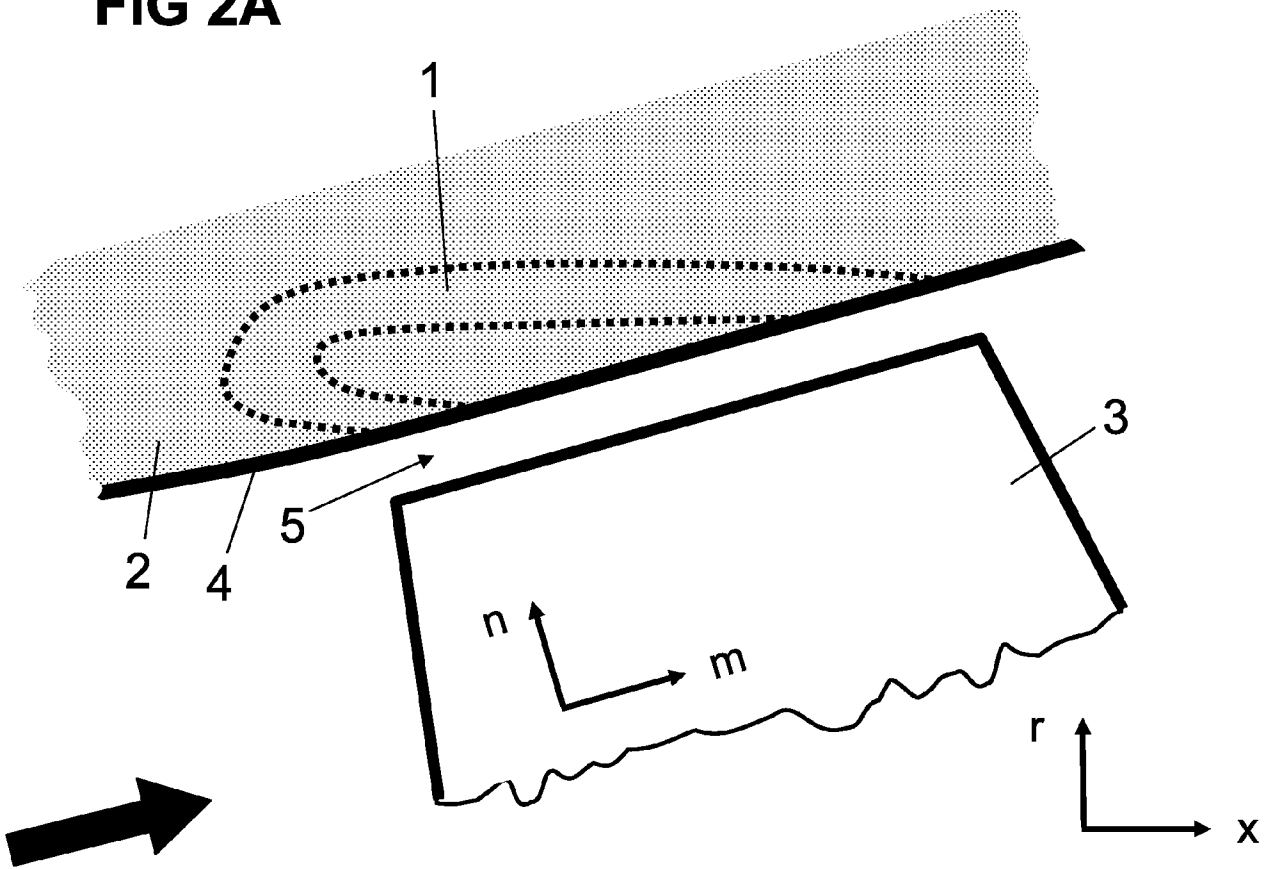
Figure 2B:
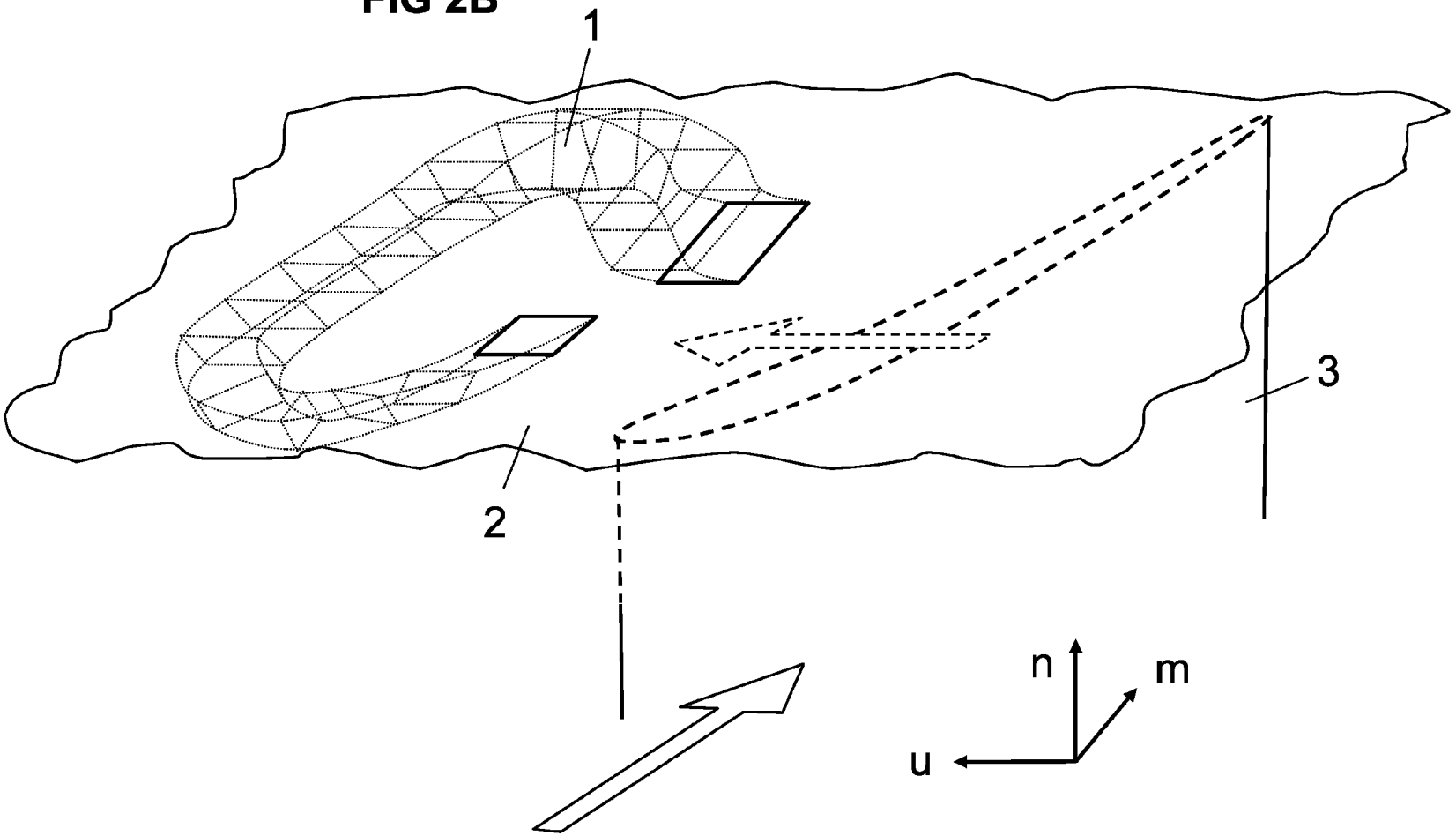
Figure 3A:
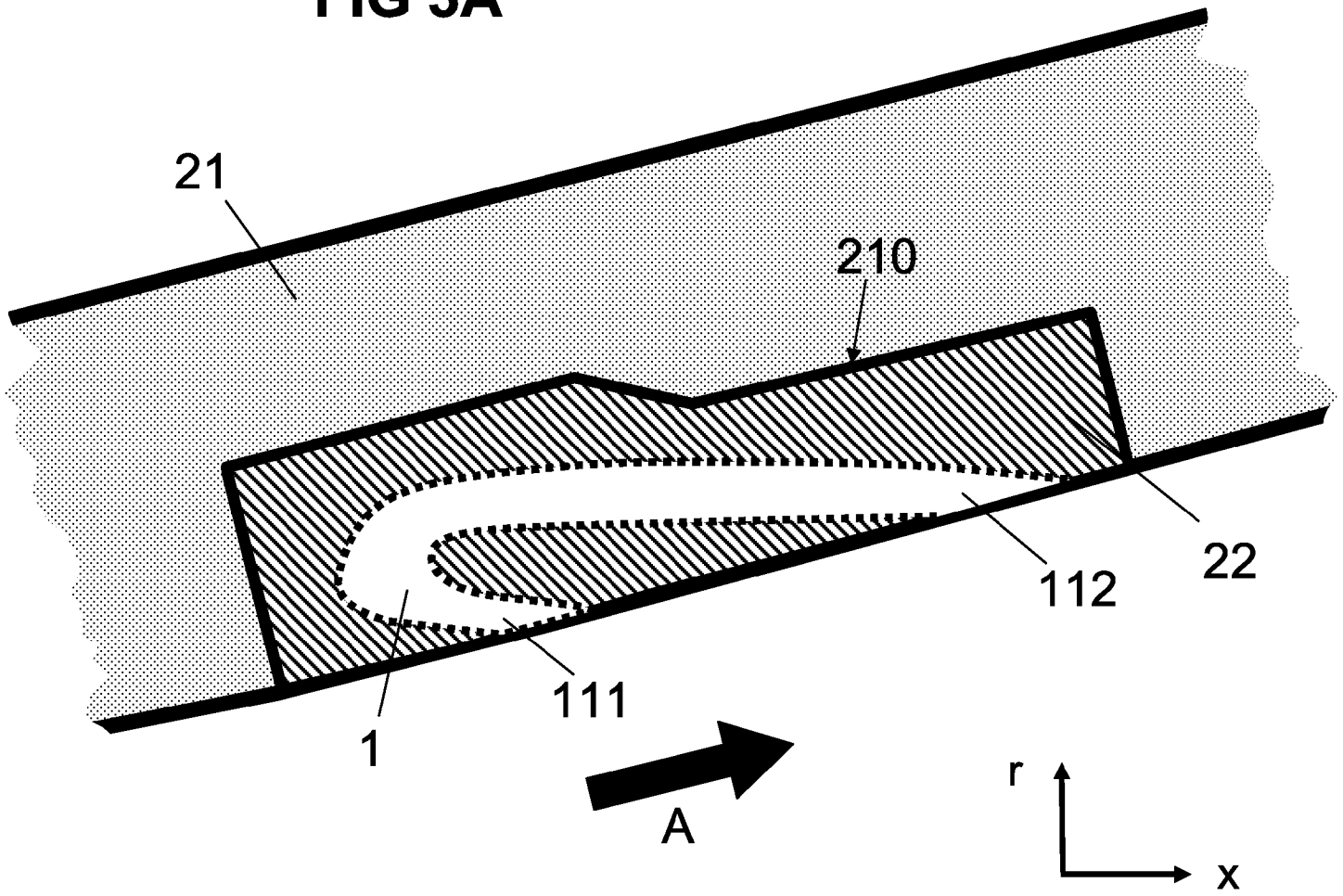
Figure 3B:
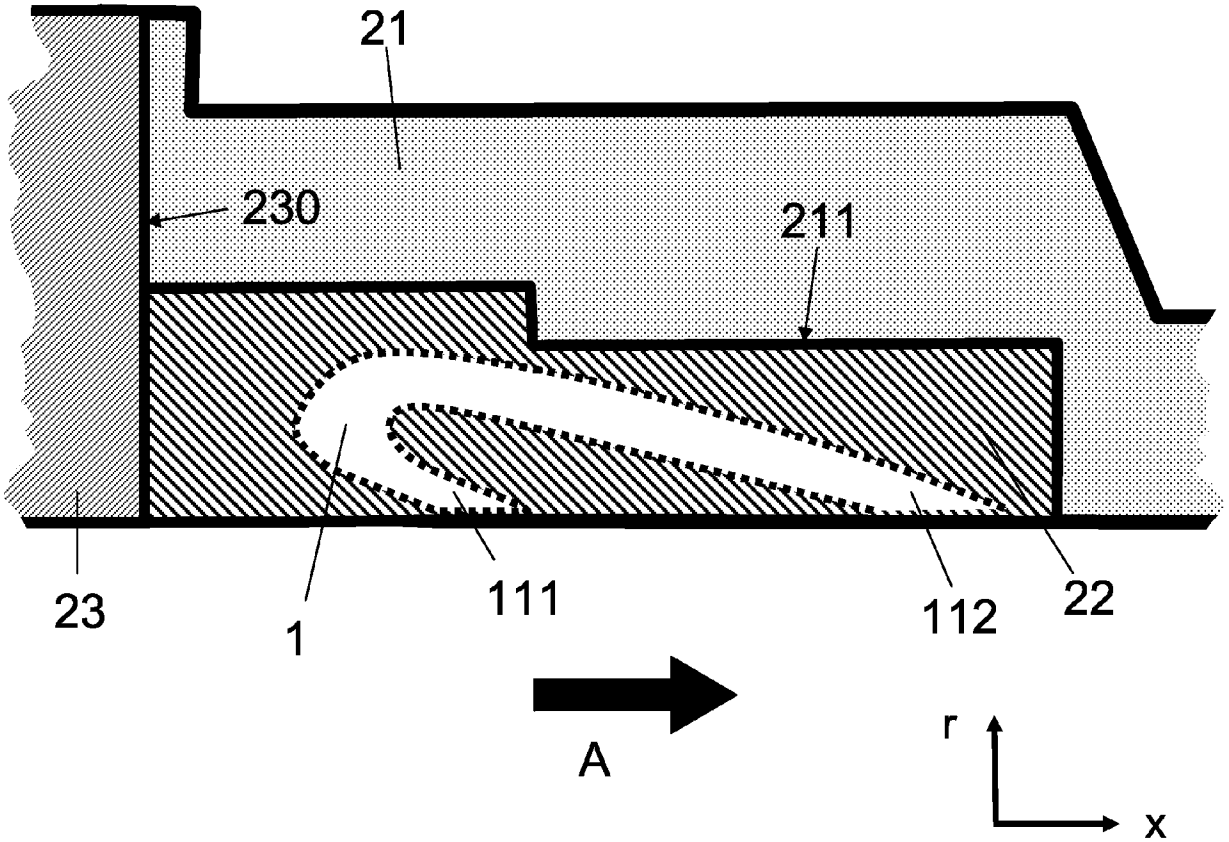
Figure 3C:
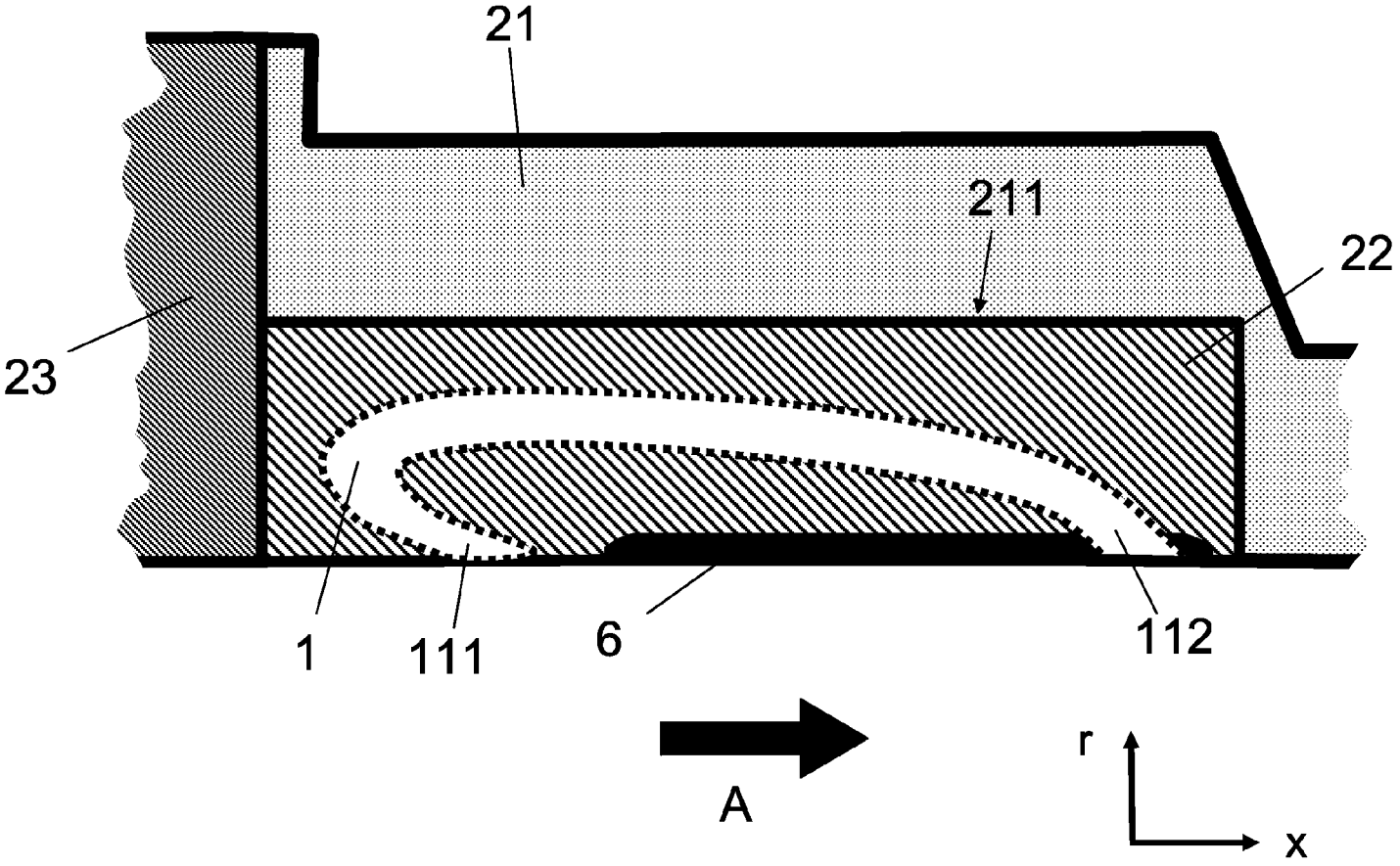
Figure 3D:
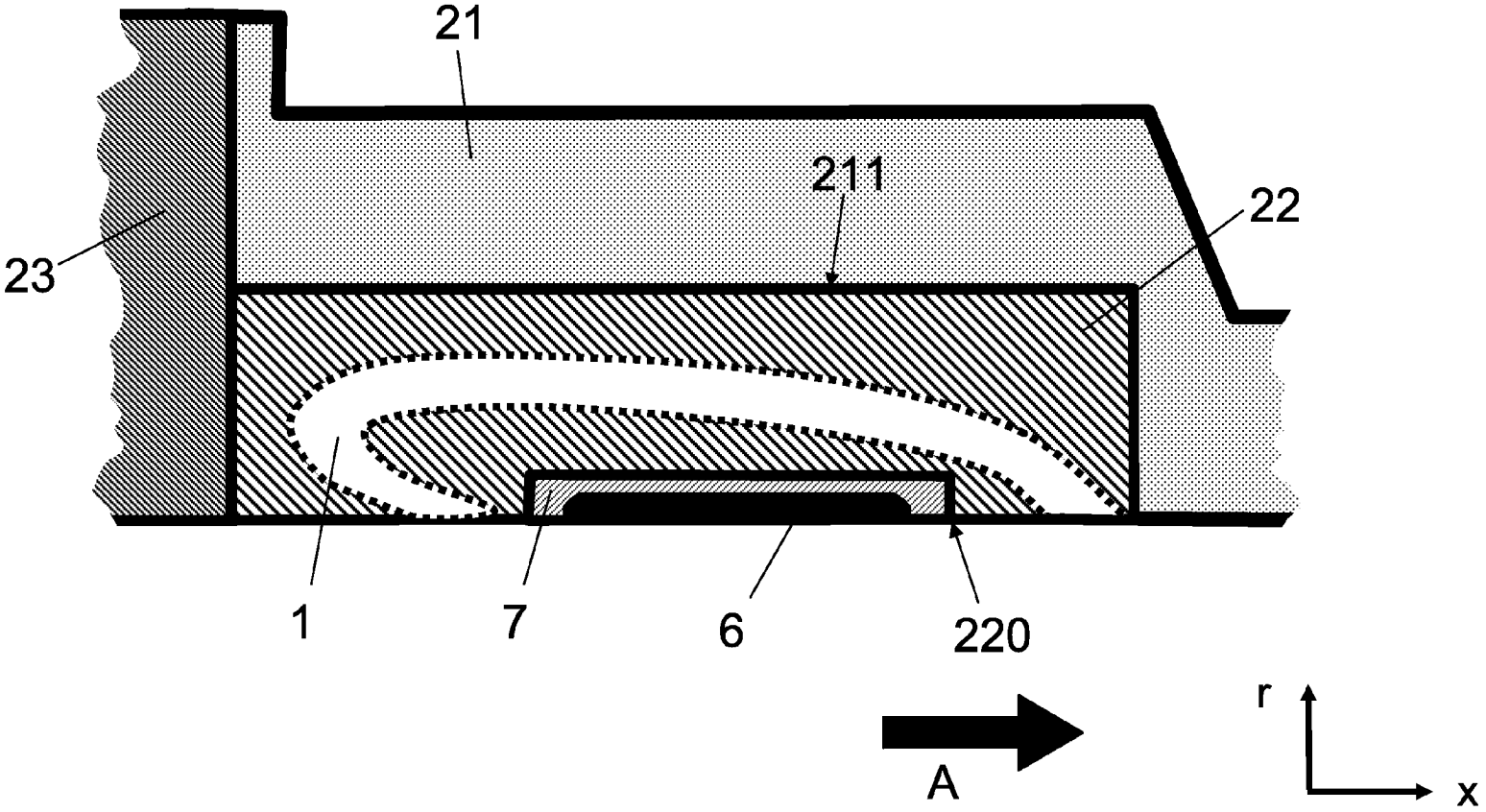

FIG. 2A shows an arrangement of a blade row 3 with free end and running gap 5 in the meridional plane established by the axial direction x and the radial direction r. The running gap 5 separates the blade tip from a component 2 associated with the main flow path on the hub or casing of the fluid-flow machine. The component 2 forms here a main flow path boundary 4 towards the main flow path.

There is a rotating relative movement between the blade tip and the component 2 associated with the main flow path. The illustration thus applies equally for the following arrangements:

1) rotating blade on stationary casing,
2) stationary blade on rotating hub,
3) stationary blade on rotating casing, and
4) rotating blade on stationary hub.

The main flow direction in the main flow path is indicated by an arrow A. Further blade rows can be located upstream and/or downstream of the blade row 3 with running gap. Inside the component 2 associated with the main flow path, a row of secondary flow ducts 1 distributed over the circumference is provided in the area of the running gap 5, said ducts having an opening at each of their ends (supply opening and discharge opening).

The openings of the secondary flow ducts are located on the main flow path boundary 4. FIG. 2A shows the outline or projection of a single secondary flow duct 1 in the meridional plane (x-r). Viewed spatially, each duct 1 has a three-dimensional and spatially winding course, shown by way of example in FIG. 2B.

It is pointed out that the cross-sectional shape of the secondary flow ducts 1 in FIG. 2B is illustrated as rectangular only by way of example. The cross-section of the secondary flow ducts 1 in other design variants can for example be designed without corners, in particular circular or elliptical.

FIG. 3A shows a structural assembly in accordance with the present invention in the area of a blade row with running gap in the meridional view (x-r). The main flow direction in the main flow path of the fluid-flow machine, in which the structural assembly is provided, is indicated by an arrow A. The blade row is no longer shown here for the sake of a simpler illustration.

In the structural assembly, at least one secondary flow duct 1 is provided which has two openings 111, 112 in main flow path boundary 4 and is connected via these openings to the main flow path. It is pointed out here that in the exemplary embodiment of FIG. 3A the secondary flow duct 1 is designed as a one-way path, having one opening through which fluid flows out of the main flow duct into the secondary flow duct and a second opening through which fluid exits the secondary flow duct. Through which of the openings 111, 112 fluid flows in, and through which of the openings 111, 112 fluid flows out, depends here on the precise positioning of the openings 111, 112 relative to the blades of the blade row 3 (cf. FIG. 2B).

In alternative embodiments, it can be provided that at least one of the secondary flow ducts is formed by an arrangement in which a single duct splits along its course into at least two part-ducts and thereby forms a type of Y-configuration. In this case, an inflow opening and several outflow openings associated with the secondary flow duct are provided. See, for instance, FIG. 4. According to a further alternative embodiment, it can be provided that at least one of the secondary flow ducts is formed by an arrangement in which at least two ducts converge into one duct, with several inflow openings and one outflow opening then being associated with the secondary flow duct. See, for instance, FIG. 5. As noted in the paragraph above, which of the openings 111 and 112 are the inflow openings or the outflow openings depends on the positioning of the openings 111 and 112 relative to the blades, so the situations noted in this paragraph could also be shown by the other of FIG. 4 or FIG. 5 than noted above depending on the positioning of the openings relative to the blades.

The structural assembly includes a support component 21 and an insertion component 22. A recess 210 running in the circumferential direction is provided in the support component 21 and receives the insertion component 22 along its circumference. The insertion component 22 (or, if several insertion components are provided, each of the insertion components) forms with some of its faces part of the outer main flow path boundary. If the structural assembly is alternatively arranged in the hub area of a fluid-flow machine, the insertion component forms in a corresponding manner with at least some of its faces part of the inner main flow path boundary of the main flow path of the fluid-flow machine.

According to FIG. 3A, it is furthermore provided that the secondary flow duct 1 is provided in the insertion component 22, and only therein, meaning that the insertion component 22 completely surrounds the secondary flow duct 1, with all wetted surfaces of the secondary flow duct 1 and any further secondary flow ducts, if applicable, being associated with the insertion component 22 in undivided manner.

The support component 21 can be part of the outward casing or of the inward hub of the fluid-flow machine and forms with some of its faces the main flow path boundary. In the exemplary embodiment shown, the support component 21 represents a part of the outward casing of the fluid-flow machine. In principle, the support component 21 can in particular be a part of the fluid-flow machine design in the following areas:

- part of a single-shell or multi-shell casing of blade rows or stages with fixed blade geometry,
- part of a single-shell or multi-shell casing of blade rows or stages with variable blade geometry,
- part of rotor drums, rotor disks or blisk modules (see FIG. 4 showing the support component 21 as part of a hub, with FIG. 5 showing the support component 21 as semi-annular, and which can be part of the hub or casing),
- part of inner shroud assemblies in the hub area of stator vanes.

In the exemplary embodiment of FIG. 3A, the support component is designed as an annular casing of a fluid-flow machine or as a half-shell casing of a fluid-flow machine. With an appropriate arrangement in the hub area, it is for example designed annular on the hub of a fluid-flow machine or semi-annular on the hub of a fluid-flow machine.

The insertion component 22 is designed in one exemplary embodiment as a complete ring placed inside the corresponding recess 210 of the structural component 21 extending in the circumferential direction. Alternatively, it is for example provided that the insertion component 22 is designed as a ring sector. It can be provided here that a plurality of secondary flow ducts are arranged along the circumference of the main flow path boundary, such that the insertion component 22 has a plurality of secondary flow ducts 1 in the circumferential direction.

Due to the possible complexity of the secondary flow ducts 1, it can be provided that the insertion component 22 is manufactured by a casting, sintering or printing production method. It can be provided, as explained, that the insertion component 22 is manufactured as a complete ring or as a ring sector using the aforementioned methods.

FIG. 3B shows a further exemplary embodiment of a structural assembly in the area of a blade row with running gap in the meridional view (x-r). In this exemplary embodiment, a recess 211 is provided in the support component 21 in such a way that it does not surround the insertion component 22 at all outer faces which are not part of the main flow path boundary. A further additional component 23 is therefore provided which is arranged in the axial direction (x) in front of the support component 21 and the insertion component 22 and has for example an annular shape with a face 230 facing the support component 21 and the insertion component 22. This arrangement allows the insertion component 22 to be pushed in the axial direction into the support component 21 in a simple manner (instead of in the radial direction as in the exemplary embodiment of FIG. 3A), and then to achieve axial positioning using the additional component 23. The additional component 23 here also forms faces which are part of the main flow path boundary.

In the exemplary embodiment of FIG. 3B too, the secondary flow duct 1 is designed completely inside the insertion component 22.

FIG. 3C shows a further variant of a structural assembly. The embodiment differs from the embodiment of FIG. 3B in that an abradable coating 6 is additionally provided directly on or in the insertion component 22, where it can be provided that at least one of the openings 111, 112 of the secondary flow duct 1 is located in an area in which the abradable coating 6 is arranged. It can be provided here that the abradable coating 6 is designed as a ring sector or complete ring on the insertion component 22 and here provides a face facing the main flow path. An abradable coating of this type is used to mesh with the blades 3 of a rotating blade row and to permit the running gap 5 to be minimized (cf. FIG. 2A).

FIG. 3D shows a further exemplary embodiment of a structural assembly. Unlike in the exemplary embodiment of FIG. 3C, it is provided that the abradable coating 6 is designed in an intermediate ring 7, which is inserted into a corresponding recess 220 in the insertion component 22. The additional ring 7 can be designed here as a complete ring or partial ring. The abradable coating 6 is provided on this ring or partial ring 7 on its face facing the main flow path.

In further embodiments of the present invention, the design solutions described with reference to the FIGS. 3A, 3B, 3C, 3D can be combined with one another. A further variant of the present invention for example provides that an abradable coating 6 is also used in the embodiment of FIG. 3A.

The present invention, in its design, is not restricted to the exemplary embodiments presented above, which are only to be understood as examples.

The shape and the embodiment of the secondary flow ducts and of the support component and the insertion component can for example be designed in a different manner than that shown.

What is claimed is:

1. A structural assembly for a fluid-flow machine comprising:

a main flow path boundary confining a main flow path of a fluid-flow machine, where a row of blades each with one blade end is arranged in the main flow path, where a gap exists between the blade ends of the row of blades and the main flow path boundary, and where there is a rotating relative movement between the blades of the row of blades and the main flow path boundary, and a secondary flow duct, having first and second openings in the main flow path boundary at ends spaced apart in a main flow direction of the main flow path, such that the secondary flow duct is connected to the main flow path via the first and second openings, wherein the secondary flow duct is a one-way duct, such that fluid flows into the secondary flow duct through the first opening and fluid exits the secondary flow duct through the second opening, wherein the structural assembly includes a support component and an insertion component, where the support component includes at least one face forming the main flow path boundary and includes a recess in the main flow path boundary, the recess extending in an axial direction with respect to the main flow direction and extending in a circumferential direction, the recess being formed in an area radially adjacent a single row of blades and comprising an upstream side, a downstream side and a center side parallel to the main flow path boundary therebetween and receiving the insertion component such that the support component surrounds the insertion component largely on sides of the insertion component not facing the main flow path and the support component completely houses the insertion component within the recess, and where the insertion component completely surrounds or forms the secondary flow duct, wherein the insertion component surrounds the secondary flow duct so completely that all wetted surfaces of the secondary flow duct are associated with the insertion component in an undivided manner, and the secondary flow duct is contained within the recess in the support component;

a further complete or partial ring adjoining the insertion component on a side facing the main flow path, the further complete or partial ring including an abradable coating on at least parts of a face of the further complete or partial ring facing the main flow path;

wherein the abradable coating is a single piece component and the first and second openings of the secondary flow duct each are arranged in an area outside an axial extent of the abradable coating;

wherein the first and second openings of the secondary flow duct are arranged upstream and downstream, respectively, of an axial extent of the blade ends.

2. The structural assembly in accordance with claim 1, wherein a face of the insertion component forms at least a portion of the main flow path boundary.

3. The structural assembly in accordance with claim 2, wherein the support component is an annular casing of a fluid-flow machine and encloses the insertion component from the outside.

4. The structural assembly in accordance with claim 2, wherein the support component is a half-shell casing of a fluid-flow machine and encloses the insertion component from the outside.

5. The structural assembly in accordance with claim 2, wherein the support component has an annular configuration on a hub of a fluid-flow machine and holds the insertion component from the inside.

6. The structural assembly in accordance with claim 2, wherein the support component has a semi-annular configuration on a hub of a fluid-flow machine and holds the insertion component from the inside.

7. The structural assembly in accordance with claim 2, wherein the insertion component is a complete ring or a ring sector.

8. The structural assembly in accordance with claim 1, wherein the support component is an annular casing of a fluid-flow machine and encloses the insertion component from the outside.

9. The structural assembly in accordance with claim 1, wherein the support component is a half-shell casing of a fluid-flow machine and encloses the insertion component from the outside.

10. The structural assembly in accordance with claim 1, wherein the support component has an annular configuration on a hub of a fluid-flow machine and holds the insertion component from the inside.

11. The structural assembly in accordance with claim 1, wherein the support component has a semi-annular configuration on a hub of a fluid-flow machine and holds the insertion component from the inside.

12. The structural assembly in accordance with claim 1, wherein the insertion component is a complete ring or a ring sector.

13. The structural assembly in accordance with claim 1, wherein the secondary flow duct is formed by an arrangement in which a single duct splits along its course into at least two ducts and forms a Y-configuration, where an inflow opening and a plurality of outflow openings are associated with the secondary flow duct.

14. The structural assembly in accordance with claim 1, wherein the secondary flow duct is formed by an arrangement in which at least two ducts converge into one duct, where a plurality of inflow openings and one outflow opening are associated with the secondary flow duct.

15. The structural assembly in accordance with claim 1, wherein the insertion component is manufactured by a casting, sintering or printing production method.

16. The structural assembly in accordance with claim 1, wherein a shape and faces of the insertion component are designed such that the insertion component can be inserted into the support component in an axial direction of the fluid-flow machine and an additional component adjoins the support component in the axial direction and fixes the insertion component.

17. The structural assembly in accordance with claim 1, wherein an abradable coating is provided on at least parts of faces of the insertion component facing the main flow path, the insertion component being a ring sector or complete ring.

18. A fluid-flow machine having a structural assembly in accordance with claim 1.

19. The structural assembly in accordance with claim 1, wherein at least a portion of each of the first and second openings is positioned within an axial extent of the single row of blades.

* * * * *